United States Patent [19]

Corbic

[11] 4,131,211

[45] Dec. 26, 1978

[54] RECEPTACLE MADE OF THERMOPLASTIC MATERIAL

[75] Inventor: Yves J. Corbic, Chatou, France

[73] Assignee: Societe dite: Gatrun Anstalt, Vaduz, Liechtenstein

[21] Appl. No.: 704,730

[22] Filed: Jul. 12, 1976

[51] Int. Cl.[2] ..... B65D 1/06

[52] U.S. Cl. ..... 215/2; 215/232; 215/305; 222/487

[58] Field of Search ..... 215/2, 305, 232; 220/359, 270; 229/43; 206/628, 633, 631; 222/487

[56] References Cited

U.S. PATENT DOCUMENTS

| | | | |
|---|---|---|---|
| 2,026,477 | 12/1935 | Lescher | 206/628 |
| 2,857,067 | 10/1958 | Lehmans | 215/2 |
| 3,251,515 | 5/1966 | Henchert | 220/270 |
| 3,266,653 | 8/1966 | Gauthier | 215/2 |
| 3,467,243 | 9/1969 | Butcher | 215/2 |
| 3,501,042 | 3/1970 | Risch | 215/232 |
| 3,902,617 | 9/1975 | Valyi | 215/2 |
| 3,908,857 | 9/1975 | Chiappe | 220/359 |
| 4,013,188 | 3/1977 | Ray | 215/232 |
| 4,022,352 | 5/1977 | Pehr | 215/305 |
| 4,029,033 | 6/1977 | Kerwin | 220/359 |

*Primary Examiner*—Ro E. Hart

*Attorney, Agent, or Firm*—Lavine & Jackson

[57] ABSTRACT

Receptacle such as a bottle, beaker or the like made of thermoplastic material, wherein each opening for extraction is constituted by a curved or polygonal slot at least partially closed on itself and made in the end wall by partially melting the thermoplastic material of which said wall is composed, and at least the parts of the end wall surrounding said slot are hermetically fast with a covering foil or cap coated with a layer of adhesive opposite said end wall.

9 Claims, 13 Drawing Figures

RECEPTACLE MADE OF THERMOPLASTIC MATERIAL

The present invention relates to a receptacle such as a beaker, bottle or the like made of thermoplastic material which comprise a side wall, an end wall integral with said side wall and intended to be provided with at least one opening for extraction, as well as a separate bottom intended hermetically to close the opening for filling, located opposite the end wall.

This type of receptacle is described for example in French Patents 1 196 104 and 1 274 576. In the case of the known receptacles, the end wall is provided with a groove closed on itself and constituting a line of least resistance, along which an opening may be cut, for example with the aid of a knife, through which the contents of the receptacle may be extracted.

The drawback of these receptacles is that they require a sharp object to open them and that the contents of the receptacle sometimes squirt out when the end wall is cut.

It is also known by French Patent 1 196 104 to firstly make the side wall of the receptacle so as to leave on the end wall side an annular portion defining the end opening, to close said opening by a lid and to provide the other end of said wall with a bottom after having previously filled said receptacle.

It is also generally known to cover the extraction opening of a receptacle with a metal sheet or disc, e.g. aluminium foil, provided with a layer of glue, preferably thermo-adhesive, and to weld or crimp said foil on the edge of the extraction opening (cf. for example French Patent 1 273 581).

It has been ascertained that the seal of a metal foil on the edge of the extraction opening is not very convenient especially when said edge is inside the periphery defined by the corresponding end of the side wall of the receptacle. This drawback is further increased when the side wall and the end wall are made by heat-forming and when the subsequent extraction opening is cut out from said end wall by suitable cutting, shearing or stamping means.

In fact, in this case, the thickness of the end wall is substantially less than that of the side wall, with the result that the extraction opening made in said end wall is delimited by a very sharp edge which makes the use of these receptacles fairly problematic. In addition, in the case of a thin edge located inside the periphery of the corresponding end of the side wall of the receptacle, the seal to be made between said edge and the metal foil by cold-gluing or by heat-sealing is often defective, with the result that the contents of the receptacle is in direct contact with the ambient air and may even escape inopportunely. Upon sealing of the metal foil on the already thermo-formed edge of the receptacle, the heat from sealing releases the internal tensions of the thermoplastic material which are due to the thermo-forming and to the sharp cooling of the thermoplastic material when it comes into contact with the mould, with the result that the edge retracts and cracks in the sealing zone.

It is an object of the present invention to eliminate these drawbacks by proposing a receptacle of the type mentioned at the beginning, which receptacle has at least one extraction opening without a sharp edge and is provided with a covering foil or cap hermetically closing said receptacle before it is used.

This object is attained, according to the invention, in that each opening for extraction is constituted by a curved or polygonal slot made by partially melting the thermoplastic material in the end wall and at least partially closed on itself and in that at least those portions of the end wall surrounding said slot are hermetically fast with a covering foil or cap coated with a layer of adhesive opposite the end wall.

In this way, the extraction openings have rounded edges since, when the slot is made by melting the thermoplastic material, said latter tends to contract so as to form rounded edges. In addition, since that end wall portion located inside the zone of the slot remains glued to the covering foil, said opening may be easily closed again, after the receptacle has been opened by removing at least part of said foil, by using as centering piece the end wall part remaining fast with said foil, after separation of said latter from the outer edge of the slot.

The invention also relates to a method of manufacturing and filling a receptacle of which one end wall is integral with the side wall when said receptacle is formed and of which the other end wall is constituted by a separate bottom, according to which method the side wall and one end wall are made in one piece in a mould by moulding under pressure or thermo-forming a thermoplastic material, the receptacle is filled through the bottom opening and said bottom opening is then closed by a separate bottom.

In the case of a method as specified hereinabove, the invention consists in depositing in the zone of the mould bottom a covering foil or cap provided, on its face opposite the zone of opening of the mould, with a layer of adhesive; in moulding the thermoplastic material of the end wall of the receptacle above said covering foil or cap at the same time as the side wall of the latter is made; in making in the end wall, in sealed contact with the glued part of the covering foil or cap by partially melting the thermoplastics material constituting said end wall, a curved or polygonal slot which is at least partially closed on itself; and in then filling the receptacle through the bottom opening which is thereafter closed by a separate bottom.

Due to these measures, a sealed contact is made between the cover foil and the end wall when the receptacle is moulded and before an opening is made in said end wall. The force of abutment exerted by the end wall on the cover foil is uniform and acts from the inside to the outside of the receptacle during the forming operation of said latter. In addition, as the end wall is already fast with the metal covering foil or cap, the marginal zone defining the slot does not undergo any deformation during its production by melting of the thermoplastic material; furthermore, the excess heat with respect to that necessary for melting the slot can soften the thermoplastic material only in the marginal zone of the slot as it is rapidly distributed and dissipated in the metal covering foil or cap.

The invention will be more readily understood on reading the following description with reference to the accompanying drawings, in which.

Figure 1:
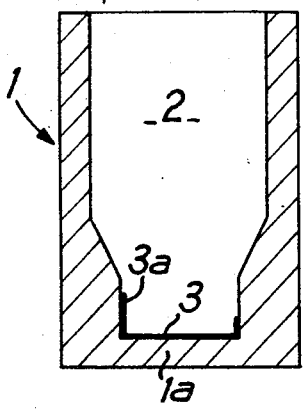
FIGS. 1 to 5 are vertical axial sections through a receptacle during the different stages of its manufacture and filling.
Figure 2:
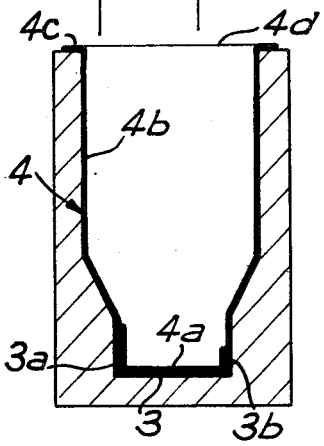

Referring now to the drawings, FIGS. 1 to 6 show a mould 1 having a cavity 2 of suitable form, for example in the form of a cylindrical, truncated or pyramidal bottle, beaker or the like in which is disposed, in the bottom zone and preferably on the very bottom 1a of said mould, a metal covering foil or cap 3, preferably made of aluminum which, on the face opposite the bottom 1a of the mould 1 and intended to adhere intimately to the end wall of the receptacle, is provided with a layer of adhesive which glues hot or cold.

Figure 7:
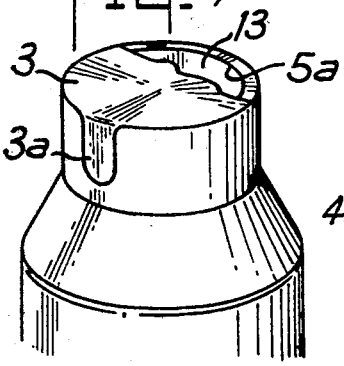
FIGS. 7 to 10 are views in perspective of different embodiments of the extraction end of the receptacle according to the invention.
Figure 8:
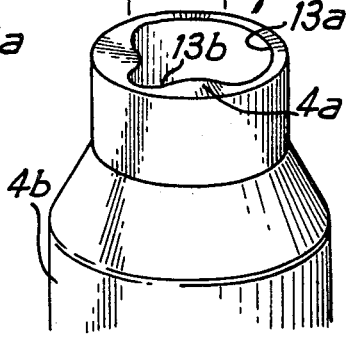
Figure 9:
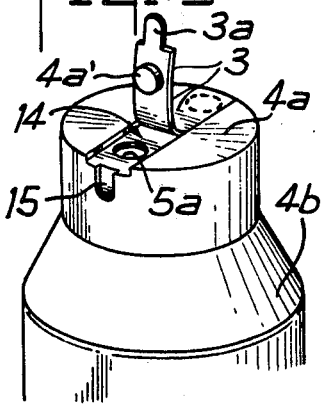

This covering foil 3 is in the form of a small cap whose edge is raised, but it may also be almost flat as shown in FIG. 7. The covering foil 3 comprises a tongue 3a which is not covered with any layer of glue or adhesive.

After having deposited the foil 3 in the mould 1, the end wall 4a and the side wall 4b of the receptacle 4 is moulded above said foil 3, for example by a well known method of thermo-forming from a thermoplastic strip or sheet, such as for example described in French Patent 1 134 142 or German Patent 1 165 241. The upper part of the side wall 4b terminates in an outwardly directed annular edge 4c surrounding an opening 4d for filling. Of course, a known method of injection moulding may also be carried out to make the receptacle 4. When the end wall 4a is moulded, it comes into contact, in the hot state, with the adhesive layer, which is preferably heat-sealing, provided on the inner face of the covering foil 3 with the exception of the portion forming tongue 3a which, moreover, automatically fits into the material of the side wall 4b in the same way as the raised edge 3b of the foil 3 if there is one (cf. for example FIG. 2). Under the effect of the uniform pressure prevailing inside the receptacle 4 and more precisely, on the side of the inner face of the end wall 4a and of the side wall 4b, and under the effect of the heat of the thermoplastics material coming in contact with said covering foil 3, the layer of adhesive establishes, after the whole has cooled down, a sealed, sufficiently solid bond between said foil 3 and said end wall 4a.

Figure 10:
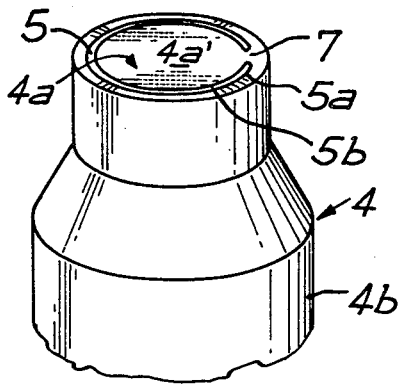
Figure 11:
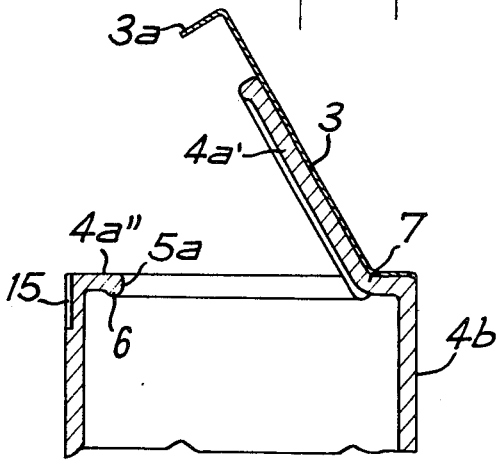
Figure 12:
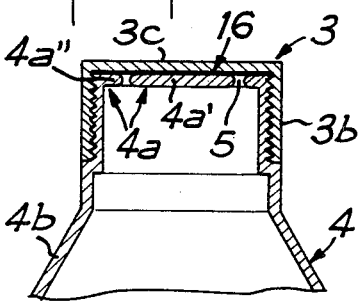
FIGS. 12 to 13 are axial sections through further embodiments of the extraction end of the receptacle according to the invention.

Once this sealed bond is established, a slot 5 of curved or polygonal form, closed at least partially on itself (cf. for example FIG. 10) is made in the end wall 4a, and more generally speaking in the wall covered by the covering foil 3. This slot 5 is made in the end wall 4a by partially melting the thermoplastic material composing same with the aid of a heated electrode 18 of suitable form, for example annular and arranged so as to be able to penetrate into the mould 1 as far as the bottom thereof. As the covering foil 3 is made of a non-fusible material, for example paper and preferably metal, particularly aluminium, the heated electrode 18 has no effect on said foil 3 and is stopped thereby since said latter rests directly on the bottom 1a or another portion of the mould 1 made of an incompressible material. When the thermoplastic material is partly melted at the moment of making the slot 5, this material escapes laterally, forming a sort of flange 6 of rounded section (cf. in particular FIG. 11) on each edge defining the slot 5. The shape of the slot 5 is generally round, oval, polygonal, etc . . . and closes at least partially on itself (cf. FIG. 10). When the slot 5 does not close entirely on itself, it is important that the joining part 7 which is integral with the end wall 4a and which connects the part defined by the outer edge 5a of said slot 5 to the part delimited by the inner edge 5b of this slot, extend along a straight line or be at least relatively short (cf. FIGS. 10 and 11). The slot 5 may also be entirely closed on itself (cf. FIGS. 1 to 9, 12 and 13) with the result that the part 4a' of the end wall 4a, delimited by the inner edge 5b of the slot, is entirely separated from part 4a'' of the end wall 4a, said part 4a'' located outside the edge 5a of the slot 5.

Figure 3:
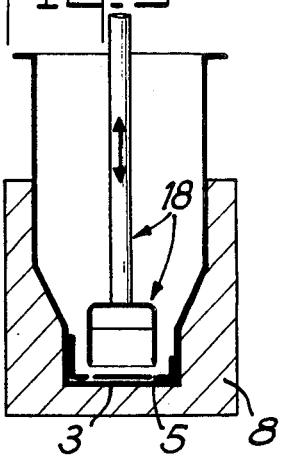
Figure 4:
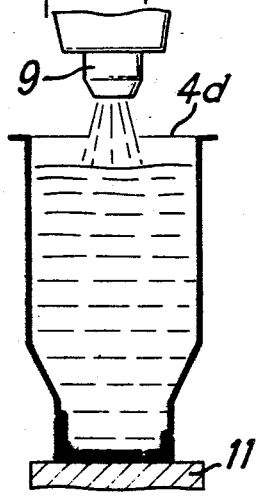

The part 4a' of the end wall 4a, part 4a' being located inside the slot 5 and entirely separated thereby from the part 4a'' located outside the said slot 5, is maintained in place by the covering foil 3 which is hermetically glued or welded both on the outer part 4a'' and on the inner part 4a' of the end wall 4a. For making the slot 5, the receptacle is not necessarily housed in the mould 1 having served for forming said receptacle 4. In fact, for making the slot 5, it is sufficient if that receptacle part, i.e. the end wall 4a, which is provided with the covering foil 3 is supported by a support 8 which may possibly also hold the receptacle 4 laterally, as shown in FIG. 3.

Figure 5:
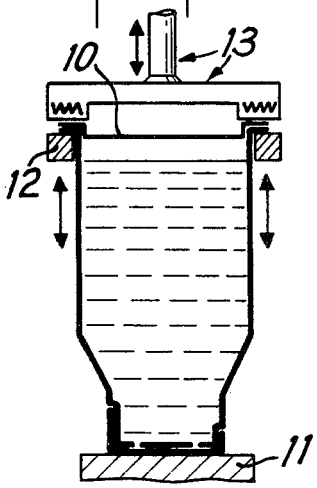
Figure 6:
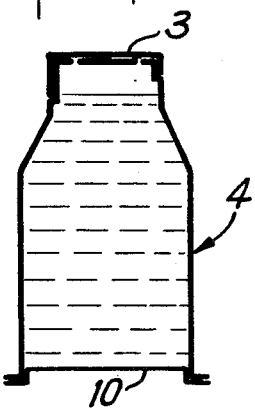
FIG. 6 is a vertical axial section through a receptacle filled and closed according to the invention.

After the slot 5 has been made, the receptacle 4 is transported to a filling station where it is filled from one or more nozzles 9 through the filling opening 4d (FIG. 4) and said receptacle 4 is then closed, for example in a sealing station where it is provided with a sectioned or flat, separate bottom 10 hermetically welded on the annular edge 4c of the receptacle 4 (cf. FIG. 5). Whilst the receptacle 4 is being filled and sealed, it rests on a support plate 11. In the sealing station, a support ring 12 and electrode 13, which are vertically movable and capable of tightening therebetween the edges of the receptacle 4 and the separate bottom 10, serve to hermetically close, in known manner, the receptacle 4 which is then placed in its normal position in which the covering foil 3 is located above the separate bottom 10 (FIG. 6).

FIG. 7 shows that the outer edge 5a of the slot constitutes at the same time the delimitation of the extraction opening 13 of the receptacle once the covering foil 3 has been removed. This extraction opening may also be shaped so as to present a semi-circular part 13a followed by an oblong part 13b forming a sort of pouring spout after the covering foil 3 has been removed (cf. FIG. 8).

It is not necessary for the covering foil 3 to cover the whole of the end wall 4a. It may for example take the form of a strip (cf. FIG. 9) which covers only a part of the end wall 4a provided in the covered zone with two slots of which the outer edges 5a constitute the extraction opening after the removal of the covering foil 3 on which adheres the part of the end wall 4a' located inside the slot 5, i.e. inside the outer edge 5a.

Of course, when the mould 1 has a flat bottom and the covering foil 3 does not cover the whole of the end wall 4a, said foil 3 fits into said wall 4a (FIG. 9) which then presents a shallow recess 14, after said foil 3 has been removed. Similarly, the tongue 3a of the covering foil 3 fits into the adjacent part of the side wall 4b forming a recess 15 therein, but with the difference with respect to the foil 3, that said tongue 3a does not adhere to the side wall 4b of the receptacle.

It is easily understood that the end wall 4a may be provided with a plurality of extraction openings in the zone of the covering foil 3. This may be advantageous when the receptacle 4 contains a powdery or granular product or pieces in bulk, etc. In this case, it may also be advantageous to provide the inner face of the covering foil 3 with a layer of glue with permanent adhesive power, with the result that, after the receptacle has been used, the covering foil 3 may be reglued on the end wall 4*a*.

In the case of the slot 5 not being entirely closed on itself (FIGS. 10 and 11), the part 4*a*' of the end wall 4*a* serves as permanently attached partial cover, the tongue 3*a* and cover foil 3 fast therewith facilitating its pivoting at the level of the joining part 7.

A cylindrical cap may also be used as covering foil 3, of which the cylindrical side wall 3*b* is threaded and of which the flat part 3*c* covers the end wall 4*a* of the receptacle 4. In this case, there is provided on the face of the cap 3 opposite the end wall 4*a*, a layer of highly viscous glue 16 which is thixotropic in behaviour, has a low shear strength and which, in addition, presents a high volumic stability. In this way, when the threaded cap 3 is rotated with respect to the side wall 4*b* of the receptacle, the sealed bond between the flat part 3*c* of said cap 3 and the outer part 4*a*" of the end wall 4*a*, said outer part 4*a*" surrounding the slot 5, is broken.

Figure 13:
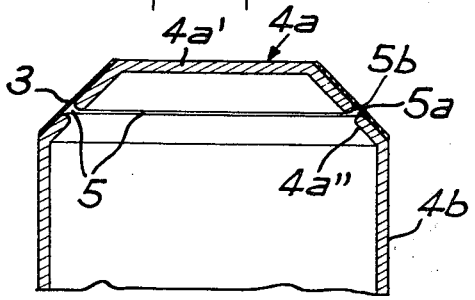

The end wall 4*a* of the receptacle is not necessarily flat. It may also be convex, spherical, pyramidal, truncated, etc . . . or may be a combination of a flat part with a non-flat part. FIG. 13 shows a part of a receptacle, which comprises in particular an end wall 4*a* composed of a flat part and of a truncated part in which the slot 5 is made. On its outer face, the truncated part of the end wall 4*a* adheres intimately to the covering foil 3 which also hermetically covers the slot 5 and is shaped so as to be able to be adapted to the truncated form of the end wall.

What is claimed is:

1. A receptacle such as a bottle, a beaker or the like, comprising: a side wall made of thermoplastic material; an end wall made of thermoplastic material and integral with said side wall; a separate bottom hermetically closing a filling opening located opposite said end wall; at least one curved or polygonal slot at least partially closed on itself formed through the entire thickness of said end wall and having edges in the form of flanges of substantially rounded section; said slot being made by melting of said thermoplastic material; and a foil or cap covering at least partially said end wall and provided with a layer of adhesive material opposite said end wall, said covering foil or cap being hermetically fast with a zone of said end wall surrounding said at least one slot and the part of said end wall surrounded by said slot, whereby at least one extraction opening delimited by said slot is provided by removing said covering foil or cap and pulling thereby said part of said end wall surrounded by said at least one slot.

2. A receptacle as claimed in claim 1, wherein said slot is closed on itself.

3. A receptacle as claimed in claim 1, wherein said covering foil comprises a non adhevive tab housed in a recess of said side wall.

4. A receptacle as claimed in claim 1, wherein the end wall comprises an opening for extraction having a part in the form of a pouring spout.

5. A receptacle as claimed in claim 1, wherein the end wall comprises at least one non-flat part provided with the slot.

6. A receptacle as claimed in claim 1, wherein the surface of the covering foil is smaller than that of a face of the end wall.

7. A receptacle as claimed in claim 1, wherein the covering foil is fitted in a recess in the end wall.

8. A receptacle as claimed in claim 1, wherein the covering foil or cap has a flat part and a cylindrical threaded part, the flat part being provided with an adhesive layer opposite the end wall of the receptacle.

9. In a receptacle having a side wall made of thermoplastic material, an end wall made of thermoplastic material and being integral with said side wall, a separate bottom hermetically closing a filling opening located opposite said end wall, the improvement comprising:

(a) a slot at least partially closed on itself formed through the entire thickness of said end wall, the edges of said slot having a substantially rounded cross-section and forming a substantially continuous smooth melted surface between the upper and lower surfaces of said end wall, and (b) a member at least partially covering said end wall and being provided with a layer of adhesive material against said end wall, said member being hermetically fastened to a zone of said end wall surrounding said slot and to the part of said end wall surrounded by said slot, whereby at least one extraction opening delimited by said slot is provided by removing said covering member and thereby pulling said part of said end wall away from the plane of said end wall.

* * * * *